United States Patent [19]

Hukuzawa et al.

[11] 4,202,187

[45] May 13, 1980

[54] WASHING BASKET OF WASHING MACHINE CAPABLE OF FUNCTIONING AS HYDROEXTRACTOR

[75] Inventors: Soiti Hukuzawa, Hitachi; Mituyuki Togasi, Iwaki; Toshiro Mori, Katsuta, all of Japan

[73] Assignee: Hitachi, Ltd., Japan

[21] Appl. No.: 913,058

[22] Filed: Jun. 6, 1978

[30] Foreign Application Priority Data

Jun. 9, 1977 [JP] Japan ..... 52-67290

[51] Int. Cl.[2] ..... D06F 17/06; D06F 23/04; D06F 37/14

[52] U.S. Cl. ..... 68/18 F; 68/23 R; 68/23.3; 68/23.6; 210/380 L; 210/474

[58] Field of Search ..... 68/18 F, 23 R, 23.3, 68/23.6, 23.7, 133, 148, 154, 174; 210/380 L, 474

[56] References Cited

U.S. PATENT DOCUMENTS

| | | | |
|---|---|---|---|
| 1,521,858 | 1/1925 | Bock | 68/23 R X |
| 1,688,555 | 10/1928 | Rankin | 68/23 R |
| 1,969,176 | 8/1934 | Kirby | 68/23.7 X |
| 3,233,436 | 2/1966 | Gibson | 68/23.6 X |
| 3,872,694 | 3/1975 | Sikamori et al. | 68/23.6 X |

FOREIGN PATENT DOCUMENTS

| | | | |
|---|---|---|---|
| 275342 | 6/1914 | Fed. Rep. of Germany | 68/23.7 |
| 1214250 | 12/1970 | United Kingdom | 68/18 F |

*Primary Examiner*—Philip R. Coe
*Attorney, Agent, or Firm*—Craig & Antonelli

[57] ABSTRACT

A washing basket adapted to be incorporated in a washing machine having a hydroextracting function. The washing basket, which is provided at its bottom with a pulsator, has a plurality of protrusions formed in its inner peripheral wall. Each of the protrusions has an arcuate cross-section whose ridge is directed toward the center of the basket, and is extending in the vertical direction along the inner peripheral wall of the basket. A plurality hydroextracting apertures are formed in each of grooves which are formed between the adjacent protrusions.

2 Claims, 6 Drawing Figures

WASHING BASKET OF WASHING MACHINE CAPABLE OF FUNCTIONING AS HYDROEXTRACTOR

The present invention relates to a washing basket of a washing machine capable of functioning also as a hydroextractor (this type of washing machine will be referred to as "washer-dryer") and, more particularly, to a washing basket of the washing machine of the kind described, having a configuration for an improved hydroextracting efficiency during the hydroextracting operation of the washing machine.

Various proposals and attempts have been made as disclosed, for example, in Japanese Patent Publication Nos. 33863/1974 and 18512/1977, concerning the configuration of the washing basket of the washer-dryers from the view point of improvement of the washing performance. However, unfortunately, no specific proposal has been made up to now as to the configuration of the washing basket, from the view point of the hydroextracting performance. Thus, the conventional arrangement for the hydroextracting function is nothing but to provide a plurality of hydroextracting apertures through the wall of the washing basket.

However, it has been shown as a result of a series of tests that these washing machines of the kind described inconveniently suffer uneven distribution of the hydroextracting effect across the radius of the washing basket. More specifically, the rate of hydroextraction is smaller for those clothes located closer to the wall of the washing basket, in spite of the larger centrifugal force, than for those clothes located at the central portion of the basket.

It is therefore an object of the invention to provide a washing basket of the washing machine of the kind described which can ensure a high hydroextracting performance uniformly over the whole part of the clothes in the washing basket, while maintaining the high washing performance.

To this end, according to the invention, there is provided a washing basket of a washer-dryer characterized by comprising a plurality of protrusions formed on the inner peripheral wall of the washing basket and extending in the vertical direction along the inner peripheral wall of the washing basket, each of the protrusions having an arcuate cross-section having a ridge projected toward the center of the washing basket, and a plurality of grooves formed in the inner peripheral wall of the washing basket at portions of the latter between adjacent protrusions, each of the grooves having a plurality of hydroextracting apertuses.

This arrangement is effective to reduce the force by which the radially outer clothes are pressed onto the inner peripheral wall of the washing basket and, therefore, to improve the penetration of the water through these clothes.

Figure 1:
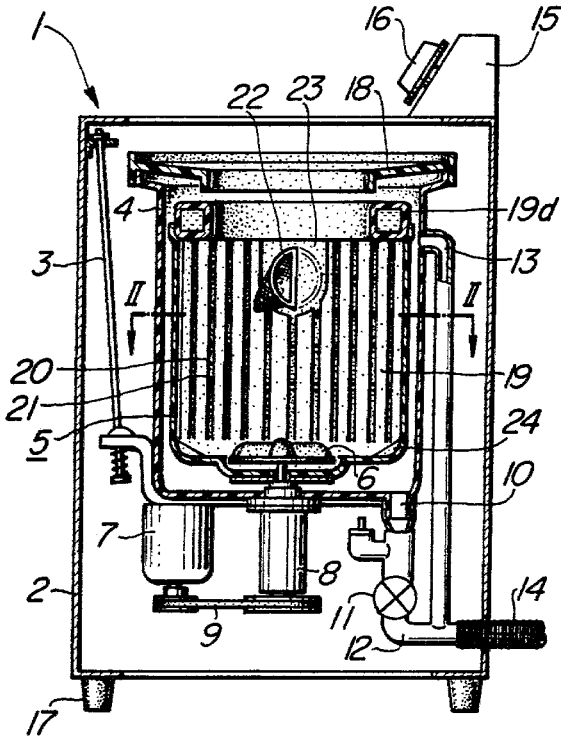
Figure 2:
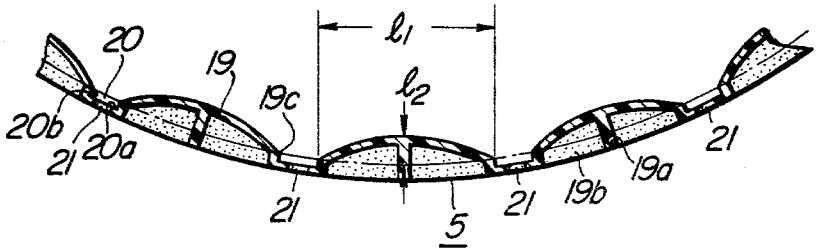
Figure 3:
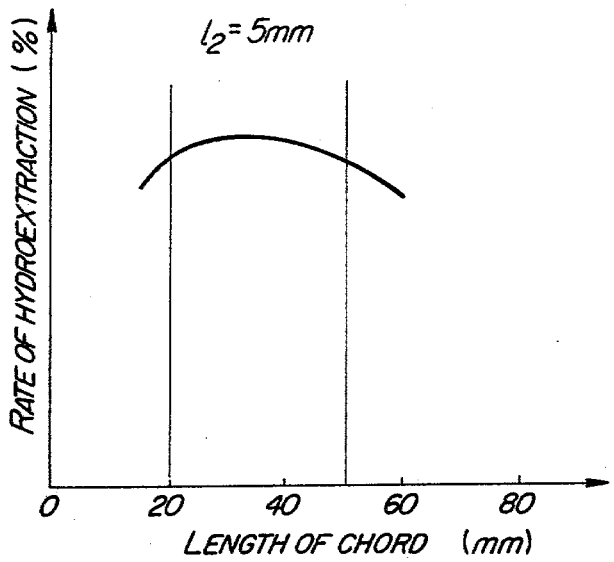
Figure 4:
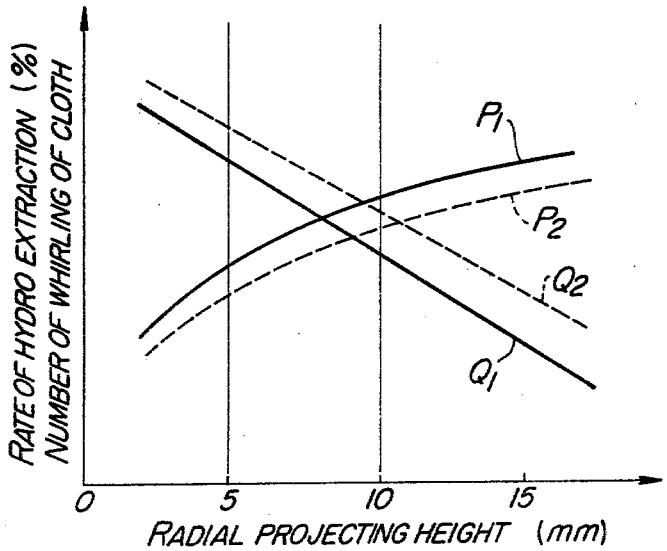
Figure 5:
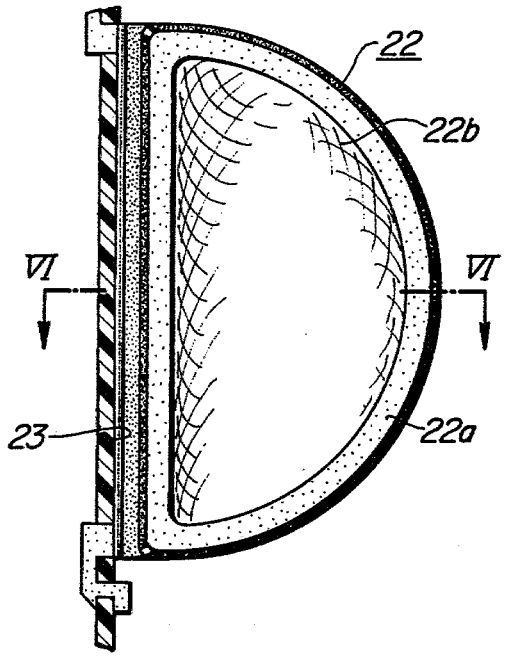
Figure 6:
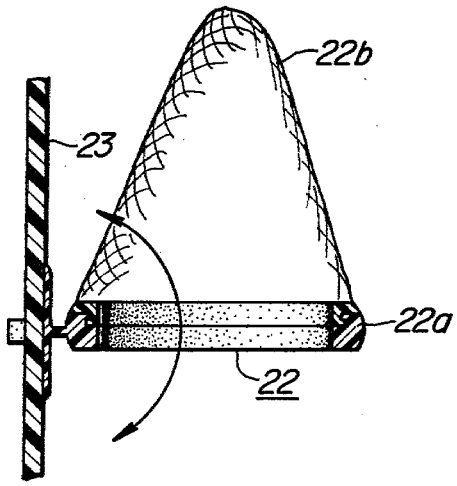

The above and other objects, as well as advantageous features of the invention will become more clear from the following description of the preferred embodiments taken in conjunction with the accompanying drawings in which:

FIG. 1 is a longitudinal sectional view of a washer dryer incorporating a washing machine embodying the present invention, FIG. 2 is a partial enlarged view of a section taken along the line II—II of FIG. 1, FIG. 3 graphically shows the relationship existing between the rate of hydroextraction and the length of the chord of the arcuate cross-section of a protrusion, FIG. 4 graphically shows how the hydroextraction rate and the number of whirling the clothes are changed by the variation of projecting heights of the protrusions, FIG. 5 is an enlarged side elevational sectional view of the washing machine as shown in FIG. 1, specifically showing the manner of attaching a lint filter, and FIG. 6 is a sectional view taken along the line VI—VI of FIG. 5.

Hereinafter, a preferred embodiment of the invention will be described with reference to the accompanying drawings.

A washer-dryer generally designated at a reference numeral 1 has an outer frame 2 formed with steel plates. A tub 4 is mounted in the outer frame 2 and is resiliently supported by means of a suspension rod 3. A washing basket 5 provided at the center of its bottom with a pulsator 6 is disposed in the tub 4. A motor 7 disposed at the bottom of the tub 4 is adapted to rotatively drive, through a belt 9, either one of the washing basket 5 and the pulsator 6, depending on the state of a clutch 8 adapted to transmit the torque to the selected one of the washing basket 5 and the pulsator 6. Namely when the clutch 8 has been switched for the washing operation, it transmits the torque of the motor to the pulsator 6, but, when switched for the hydroextracting operation, it delivers the torque to the washing basket 5.

A draining pipe 12 having a drain valve 11 adapted to be actuated by, for example, a solenoid (not shown) is connected to a draining port 10 provided at the bottom of the tub 4. The drain valve 11 is adapted to be actuated to open the drain passage of the drain pipe 12, when the washing or the rinsing operation is over.

An overflow pipe 13, by which the water spilt over the wall of the tub 4 is collected, is provided to open at the upper end portion of the wall of the tub 4. The water flowing down through the overflow pipe 13 and/or the draining pipe 12 is discharged out of the frame 2 through a flexible water discharging hose 14.

A control box or a console 15 accommodating a timer and other electric parts (not shown) for controlling the operations of the pulsator 6, washing basket 5, drain valve 11 and so forth is mounted on the upper face of the outer frame 2. Dials 16 and the like for controlling the operations of the timer and other electric parts are mounted on the console 15.

The outer frame 2 is resiliently supported by means of resilient legs 17. A cover 18 provided at the upper end of the tub 4 is adapted to prevent the clothes from dropping into the space between the washing basket 5 and the tub 4.

The washing basket 5 is made of a plastic, and its wall is inclined to diverge toward the upper side end thereof, although not clearly seen from the drawings.

A plurality of protrusions 19, each of which has an arcuate cross-section, are formed on the inner peripheral wall of the washing basket 5, such that the ridges of the protrusions are directed toward the center of the washing basket 5. These protrusions are disposed over the entire circumference of the inner peripheral wall of the washing basket 5, and are extending in the vertical direction along the same wall.

At each side of each protrusion 19, there is formed a groove 20 having a number of vertically spaced hydroextracting apertures 21.

A plurality of baffle plates 24 are provided at the bottom of the washing basket 5, so as to promote the shifting of the positions of the clothes in the washing basket 5.

Each of the protrusions 19 has a vertical rib 19*a* and a circumferential rib 19*b*. These ribs 19*a*, 19*b* are effective to increase the rigidity of the washing basket 5, so as to enable the latter to withstand a strong vibration which may be caused during the hydroextracting operation of the washing machine. A balance ring 19*d* charged with a liquid or the like is fixed to the upper brim of the washing basket 5.

The inner peripheral wall of the washing machine is partially smoothened as at 23, for allowing an installation of a lint filter 22.

The flattened area 23 is formed to occupy the same circumferential plane as the bottom of the grooves 20 and has a size large enough to avoid the contact of the lint filter 22 with the protrusions 19, even when the latter is swung right and left.

As will be seen from FIGS. 5 and 6, the lint filter 22 is hinged at its portion to the flattened area of the washing basket 5. The lint filter 22 has a semicircular frame 22 a made of a plastic and a net 22*b* secured to the frame 22*a*.

The lint filter 22 is adapted to be projected into the washing basket 5, so that its net 22*b* may arrest the lints. The arrangement is such that the lint filter 22 as a whole is swung toward the inner peripheral wall of the washing basket 5 by the clothes, when contacted by the latter. When the swirl of the clothes is reversed as a result of the switching of the pulsator 6, the filter 22 as a whole is swung around the pivot axis, to the opposite side as illustrated by two-dots-and-dash line in FIG. 1.

Concerning the design of the protrusion 19, referring to FIG. 2, the length $l_1$ of the chord of the cross-section of each protrusion is selected preferably to fall within the range of between 20 mm and 50 mm, as will be seen from the data as shown in FIG. 3 which have been obtained through experiments. Also, the radial projecting height $l_2$ of each protrusion is selected to fall within a range of between 5 mm and 10 mm, when the data of FIG. 4 which are drawn for the clothes behaviour and the hydroextracting rate in relation with the radial projecting height.

More specifically, FIg. 3 shows how the hydroextracting rate is changed as the length $l_1$ is varied, when the projecting height $l_2$ is fixed at 5 mm. It will be seen that a specifically high hydroextracting rate is obtained when the length $l_1$ of the chord is between 20 mm and 50 mm.

Turning now to FIG. 4, the curves $P_1$ and $p_2$, and $Q_1$ and $Q_2$ show, how the hydroextracting rates and the numbers of whirling clothes are changed as the projecting length $l_2$ is varied. The curves $P_1$ and $Q_1$, and the curves $P_2$ and $Q_2$ are drawn for the lengths $l_1$ of the chords of 30 mm and 50 mm, respectively. It will be seen from the curves of FIG. 4, that the range of the projecting length $l_2$ of between 5 and 10 mm, in which acceptable hydroextraction rate and the acceptable number of whirling of cloth flow are compatible.

Although not illustrated, the edge lines at which the walls of the surface of each protrusion 19 merge in the walls of the adjacent grooves and the corners 20*a*, 20*b* of each groove 20 are preferably chamfered, so as to facilitate the shaping of the wall of the washing sink 5 and, at the same time, to protect the clothes against any damage which may be incurred during the operation of the machine.

In operation, as the washing basket 5 is rotated at a high speed for the hydroextraction, the clothes are pressed onto the inner peripheral wall of the basket 5, and are partly received by the grooves 20.

The water content or moisture in the cloths is then forced to move through the clothes toward the portions of the latter received by the grooves 20. The water content or moisture reaching the portions of the clothes in the grooves is then made to move upward through these portions of the clothes along the grooves 20, and is discharged into the tub 4 through the closest hydroextracting apertures 21.

In this connection it is to be pointed out that, in the conventional washer-dryers, an equilibrium of forces is soon established between the centrifugal force acting on the mass of water contained in the clothes and the surface tension or the affinity of the water to the clothes, as the moisture content or wetness of the clothes is reduced in the course of the hydroextraction. Once this state of equilibrium is reached, almost no further hydroextraction is performed, however long the washing basket 5 may be rotated.

However, this problem is fairly overcome by the described embodiment of the invention, as will be understood from the following explanation.

Namely, according to the invention, components of the centrifugal force are imparted to the masses of water in the clothes to act in the directions in which the grooves 20 extend, due to the provisions of the protrusions 19. Consequently, the masses of water are forced to move through the clothes, so as to be concentrated or accumulated at the portions of the clothes received by the grooves 20. the masses of water can be moved through the microscopic gaps between fibers of the clothes, by a smaller motive force than the force required for the taking off of these masses from the clothes into the atmosphere. Thus, those masses of water which could never be separated from the clothes by the conventional hydroextracting technic are conveniently moved through the clothes, so as to be concentrated at the portions of the clothes in the grooves 20, so as to enrich these portions in the moisture content. Due to the concentration of the masses of water, the centrifugal force acting on the masses of water in these portions of the clothes is increased to overcome the surface tension or the affinity of the water to the clothes, thereby to allow the separation of the water from the cloths. The separated masses of water are then discharged through the hydroextracting apertures 21 formed in the grooves 20. At the same time, the masses of water residing in the clothes positioned around the center of the washing basket 5 are made to smoothly move through the microscopic gaps between the fibers of the clothes, toward the portions of the clothes in the grooves 20, so that a substantially uniform dryness distribution is obtained over the whole part of the clothes.

At the same time, by designing the protrusions 19 having the radial projection height of the aforementioned range, the movement of the clothes is rendered as vigorous as at least that obtained in the conventional washer-dryer. This considerably contributes, in combination with the moderate impacts imparted to the clothes by the protrusions, to improve the washing performance.

In addition, the protrusions are not formed on the portion of the inner peripheral wall of the washing basket 5 over which the lint filter 22 is swung from the left to the right and vice versa, so as to provide a smooth area 23 which occupies the same circumferential plane as the bottoms of the grooves 20. In conventional washer-dryer, it has been often experienced that the hinge of the lint filter 22 is entangled with the clothes, so as to hinder the free movement of the latter. However, according to the invention, such an entanglement is fairly avoided thanks to the above stated arrangement of the lint filter 22.

From the foregoing description of a preferred embodiment, it will be seen that a washing basket which affords a uniform hydroextraction over the entire portion of the clothes, as well as improved hydroextracting and washing performances, is provided by the present invention.

Having described the invention through a preferred embodiment, it is to be noted here that the described embodiment is not exclusive, and various changes and modifications may be imparted thereto, without departing from the scope and spirit of the invention which are limited solely by the appended claims.

What is claimed is:

1. A washing machine having a hydroextracting function comprising: an outer frame; an outer tub resiliently supported in said outer frame by suspension rod means; a plastic washing basket having a hydroextracting function rotatably supported in said outer tub and provided with a bottom and an upwardly extending side wall; a pulsator provided in said washing basket, substantially at a center of the bottom of said washing basket; driving means provided outside of said outer tub for rotating said pulsator during a washing operation and rotating said washing basket during a hydroextracting operation; means for draining the water from a bottom of said outer tub; means for overflowing the water from an upper portion of a side wall of said outer tub; said side wall of the washing basket having formed on an inner peripheral surface thereof a plurality of longitudinally extending protrusions, each of said protrusions having an arcuate cross-section projecting inwardly of said washing basket, and a plurality of longitudinally extending grooves, each of said grooves being formed between said longitudinally extending projections so that said protrusions and the grooves are alternatively disposed over the entire circumference of the inner peripheral surface of the side wall of said washing basket, wherein hydroextracting apertures are formed at least in bottoms of said grooves, the width of said protrusions being within a range of 20 mm to 50 mm, and the depth of said grooves being within a range of 5 mm to 10 mm, and said washing basket further being provided with baffle plates at the bottom of said washing basket.

2. A washing machine having a hydroextracting function comprising: an outer frame; an outer tub resiliently supported in said outer frame by suspension rod means; a washing basket having a hydroextracting function rotatably supported in said outer tub and provided with a bottom and an upwardly extending side wall; a pulsator provided in said washing basket, substantially at a center of the bottom of said washing basket; driving means provided outside of said outer tub for rotating said pulsator during a washing operation and rotating said washing basket during a hydroextracting operation; means for draining the water from a bottom of said outer tub; means for overflowing the water from an upper portion of a side wall of said outer tub; said side wall of the washing basket being provided on an inner peripheral surface thereof with a plurality of longitudinally extending protrusions, each of said protrusions having an arcuate cross-section projecting inwardly of said washing basket, and a plurality of longitudinally extending grooves, each of said grooves being formed between said longitudinally extending projections so that said protrusions and the grooves are alternatively disposed over the entire circumference of the inner peripheral surface of the side wall of said washing basket, wherein hydroextracting apertures are formed at least in bottoms of said grooves, the width of said protrusions being within a range of 20 mm to 50 mm, and the depth of said grooves being within a range of 5 mm to 10 mm, and said washing basket further being provided with baffle plates at the bottom of said washing basket, wherein the inner peripheral surface of said side wall of the washing basket is partially smoothed to form a flattened area occupying the same circumferential plane as the bottom of said grooves, a lint filter is hinged to said flattened area, and the size of said flattened area is large enough to prevent said lint filter from contacting with said projections when the lint filter swings laterally.

* * * * *